United States Patent [19]

Wössner

[11] 4,199,878

[45] Apr. 29, 1980

[54] BALLET AND TOE-DANCE SHOE

[76] Inventor: Hugo Wössner, Hauptstr. 28, 7701 Emmingen-Liptingen, Fed. Rep. of Germany

[21] Appl. No.: 932,377

[22] Filed: Aug. 9, 1978

[30] Foreign Application Priority Data

Aug. 17, 1977 [DE] Fed. Rep. of Germany ..... 2736974

[51] Int. Cl.[2] ..... A43B 3/00; A43B 23/00; A43B 13/38

[52] U.S. Cl. ..... 36/113; 36/108; 36/44

[58] Field of Search ..... 36/113, 107, 108, 68, 36/77 R, 77 M, 76 R, 76 C, 43, 44

[56] References Cited

U.S. PATENT DOCUMENTS

| | | | |
|---|---|---|---|
| 1,813,561 | 7/1931 | Capezio | 36/113 |
| 2,912,772 | 11/1959 | Harrison | 36/108 |
| 3,797,137 | 3/1974 | Harkness | 36/113 |
| 4,026,046 | 5/1977 | Clark et al. | 36/113 |
| 4,099,342 | 7/1978 | Singh | 36/44 |

*Primary Examiner*—Patrick D. Lawson
*Attorney, Agent, or Firm*—Irvin A. Lavine

[57] ABSTRACT

The invention relates to a ballet and toe-dance shoe with a toe, sole, and flexible shank, whereby the toe and sole are integral. Stiffening means run lengthwise and are connected to the sole.

14 Claims, 8 Drawing Figures

14
24

12
26
32
34
34
VII
VII 15
30

16
30

16
12
34
32

BALLET AND TOE-DANCE SHOE

Ballet shoes generally used heretofore for toe dancing have a stiff toe, made of leather, celluloid-saturated felt, or plastic and a more or less rigid sole, whereby a shank surrounding the foot, and consisting of flexible material, for example fabric, is attached to the toe and sole.

The connection between the toe and sole is not easy to manufacture, and can come loose after prolonged use.

For a long time, an attempt to make the toe and sole integral has been known. In this attempt, leather was used, which although it made it possible to confer the necessary stiffness on the sole, disadvantageously affected the properties of the toe. A seam had to be provided in the center of the toe, running lengthwise through the shoe, said seam being very disadvantageous as far as the rigidity of the leather material is concerned. In order to confer the necessary rigidity on the sole, a rather stiff leather had to be used, making the toe too stiff and resulting in chafed and sore feet. This known shoe has therefore not proven practical.

However, it is not a simple matter to find a material which lends to the sole sufficient stiffness while remaining sufficiently elastic when worn to protect the foot.

The invention is designed to provide a ballet and toe-dance shoe wherein the toe and sole are integral, giving the sole sufficient stiffness while remaining sufficiently elastic in the vicinity of the toe. Hence, the sole must have adjustable flexing and twisting resistance. Although these shoes have advantages, their manufacture remains to be simplified by comparison with known shoes.

This goal is achieved according to the invention by virtue of the fact that the toe and sole consist of polyurethane or elastomeric polyester.

It has been found that polyurethane and elastomeric polyester confer the desired rigidity in the vicinity of the sole, while the toe can be made somewhat stiffer in the forward part and somewhat more elastic in the rearward part by making the material of different thickness. The stiffness of the sole can be adjusted by using different thicknesses. The material used has all of the required characteristics as far as stiffness, breaking-strength, and elasticity are concerned. The manufacture of the shoe according to the invention is quite simple, since only a single piece of plastic, to which the shank is applied must be cast.

A preferred embodiment of the shoe according to the invention consists in connecting at least one stiffening part, running lengthwise, firmly to the sole, in the form of a vulcanized fiber strip or a spring steel strip or a combination of vulcanized fiber and spring steel strip. The stiffening part increases the stiffness in the vicinity of the sole. By varying the thickness and width of the stiffening part, for example the spring or springs, this rigidity can be adjusted as desired. By virtue of the properties of the plastic and stiffening parts used, the shoe always resumes its original shape after being subjected to stress, something which cannot be achieved in known shoes.

To increase the strength of the sole, a number of parallel stiffening parts can also be connected to the sole, the thickness of said parts and their width likewise being variable.

In an advantageous embodiment of the invention, the stiffening parts are subjected to pretensioning, which causes the sole to be bent upward after being fastened to these parts. This is advantageous for the desired strength characteristics of the sole.

Advantageously, the stiffening parts are cast in the material of the sole during manufacture. This results in an extraordinarily strong connection which also contributes to the flexing and twisting resistance of the soles in the manner of plywood.

However, according to another embodiment of the invention, the stiffening parts can be inserted in grooves on the underside of the sole and fastened therein. Advantageously, during manufacture of the soles, projecting noses can be shaped in the sidewalls of the grooves, said noses holding the reinforcing parts in place. Then the springs can be cast in place and glued in position with a plastic adhesive, preferably a polyamide or neoprene.

For further stiffening and adjustment to the soles of the feet, in an advantageous embodiment of the invention, an inside sole can be fastened to the upper side of the sole. The inside sole preferably consists of normal inside sole material, but the stiffer types are made of vulcanized fiber. This material does not harm the skin and is nevertheless relatively stiff. The inside sole has the particular purpose of preventing excessive lateral twisting or turning of the sole and taking up and distributing any pressure from the ends of the steel springs. The stiffening parts can also be glued directly to the underside of the inside sole.

To simplify manufacture, the inside sole can also be cast in place in the sole when the latter is manufactured.

In order to make the inside of the toe and the upper surface of the sole and/or inside sole even less harmful to the skin, they are preferably covered with an unpadded lining. The lining material advantageously has a lower melting point than the material of the toe and the sole and/or inside sole. It can also be cast directly into the toe and sole and/or inside sole when the latter are manufactured. A polyamide fabric is preferred as the material for the inner lining.

Embodiments of the invention are described in greater detail hereinbelow with reference to the drawings.

Figure 2:
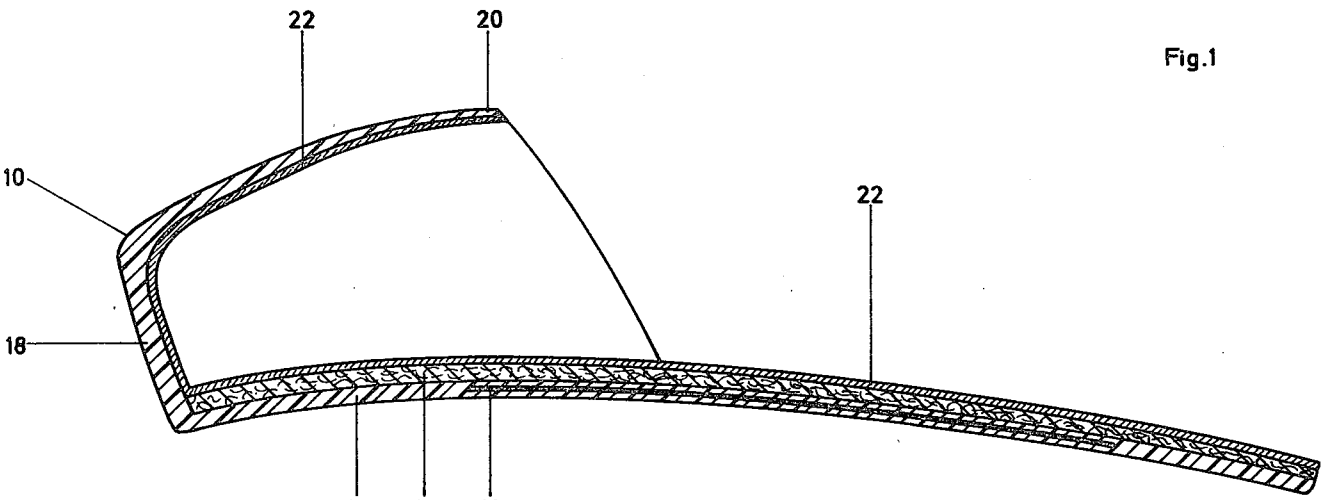
FIG. 2 is a vertical lengthwise section through the ballet shoe shown in FIG. 1.
Figure 2A:
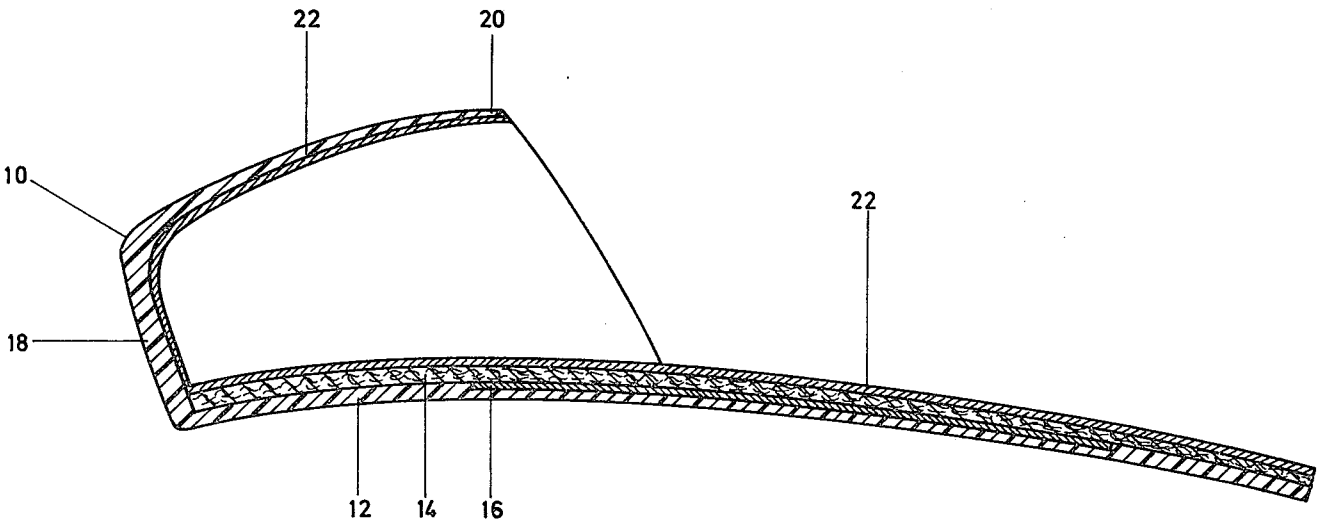
Figures 3, 4, 5, 6, 7:
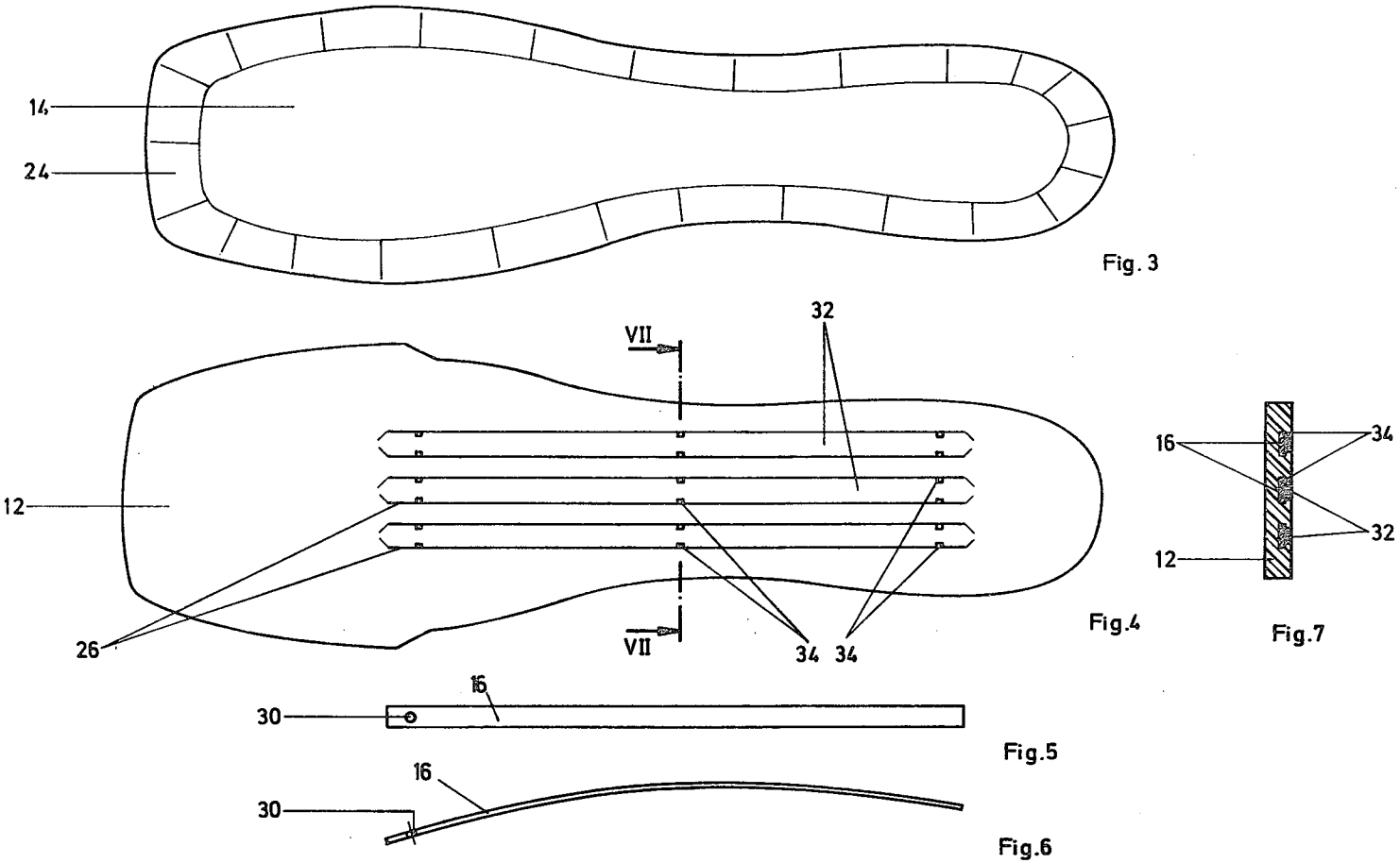

FIG. 2*a* is a cross section corresponding to FIG. 2 through a modified embodiment of the ballet shoe;

FIG. 3 is a top view of the underside of the inside sole to be applied to the sole;

FIG. 4 is a top view of the underside of another embodiment of the sole;

FIG. 5 is a top view of a stiffening part to be inserted in the sole;

FIG. 6 is a side view of the stiffening part shown in FIG. 5, and

FIG. 7 is a cross section along line VII—VII in FIG. 4.

Figure 1:
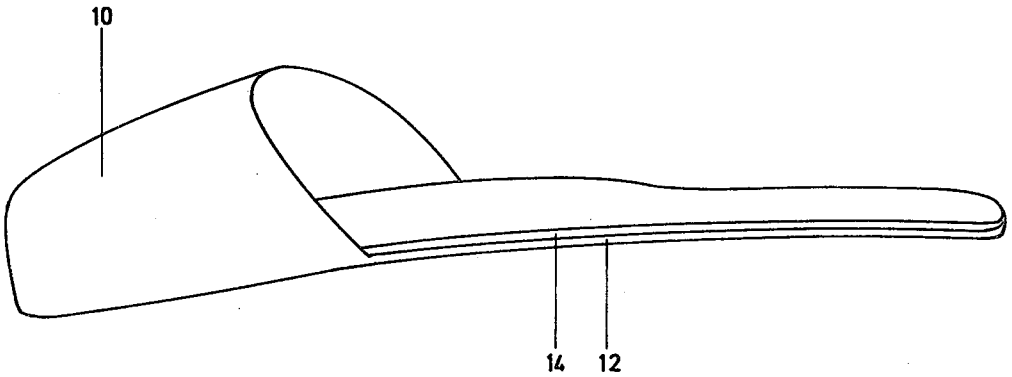
FIG. 1 is a perspective view of the ballet shoe according to the invention.

The ballet shoe shown in FIGS. 1 and 2 is provided with a toe 10 and a sole 12, made integrally of a flexible plastic. An inside sole 14 is fastened to the upper side of sole 12. At least one stiffening part 16 is cast in place lengthwise in sole 12. It extends over the main part of the sole, but ends a short distance from the forward and rearward ends of the sole. As shown in FIG. 2*a*, stiffening part 16' can also be fastened directly, for example by gluing, to inside sole 14. Toe 10 has a greater thickness at tip 18 of the shoe than at rearward edge 20, said rearward edge tapering and becoming thinner to confer greater flexibility.

The inside of toe 10 and the upper side of inside sole 14 are covered by a non-cushioned lining 22, preferably consisting of a polyamide. As FIG. 3 shows, lining 22 is turned downward around the edge of inside sole 14 and a projecting edge 24 of the lining is firmly attached, for example by gluing, to the underside of inside sole 14. In a preferred embodiment, lining 22 together with inside sole 14 is cast directly in toe 10 and sole 12 when the latter are manufactured. The entire ballet shoe, with the exception of the shank which is not shown in the drawings, can therefore be made in a single work step and has all of the required properties.

In a second embodiment shown in FIGS. 4 to 7, sole 12 is provided on its underside with parallel grooves 26, said grooves flattening out at the forward and rearward ends and merging with the lower surface of the sole. One stiffening part 16 is inserted in each of these grooves, as shown in FIGS. 5 and 6. Stiffening parts 16, inserted in grooves 26, are cast in plastic, preferably a polyamide 32, said plastic filling the grooves completely and being attached to the undersides of the soles. The stiffening parts can be provided with through holes 30, which the polyamide penetrates for better attachment. Furthermore, in order to increase the strength of the attachment of stiffening parts 16 to grooves 26, projecting noses 34 are provided which hold the stiffening parts in the grooves.

Of course, additional padding can be applied inside toe 10 in the usual fashion, if necessary. As FIG. 6 indicates, stiffening parts 16 are pretensioned, producing a slight convexity after they are cast in the soles (FIGS. 1 and 2) or after they are inserted in grooves 26 in sole 12, whereby the central part of the sole is located somewhat higher than the two ends. This is advantageous to achieve the necessary stiffness.

I claim:

1. A ballet and toe dance shoe comprising a toe and sole, the toe and sole being integral and made of polyurethane or elastomeric polyester, and stiffening means comprising a plurality of substantially parallel stiffening members running lengthwise connected to the sole.

2. The shoe of claim 1, said stiffening means being pretensioned, whereby to produce upward convexity of said sole.

3. The shoe of claim 1, said stiffening means being embedded into said sole and surrounded thereby.

4. The shoe of claim 1, said sole having grooves on the underside thereof, said stiffening means in said groove.

5. The shoe of claim 4, said groove means having projecting noses for holding said stiffening means therein.

6. The shoe of claim 1, said stiffening means comprising an elastic strip of vulcanized rubber or spring steel or both.

7. The shoe of claim 1, and an inside sole fastened to the upper side of said sole.

8. The shoe of claim 7, said inside sole consisting of vulcanized fiber.

9. The shoe of claim 7, said inside sole being cast in said first mentioned sole.

10. The shoe of claim 7, said stiffening means being glued to the undersides of said inside sole.

11. The shoe of claim 1, and an unpadded lining covering the insides of the toes and the upper sides of the sole and/or inside soles.

12. The shoe of claim 11, said lining material having a lower melting point than the melting point of the material of the toe and sole and/or said inside sole.

13. The shoe of claim 12, said lining being cast with said toe and sole and/or inside sole.

14. The shoe according to claim 12, said lining consisting of polyamide.

* * * * *